US005123588A

United States Patent [19]

Harris

[11] Patent Number: 5,123,588

[45] Date of Patent: Jun. 23, 1992

[54] BASKET-STYLE CARRIER WITH HANDLE AND DIVIDER CELLS

[75] Inventor: Randall L. Harris, Monroe, La.

[73] Assignee: Riverwood International Corporation, Denver, Colo.

[21] Appl. No.: 754,833

[22] Filed: Sep. 4, 1991

[51] Int. Cl.[5] ..... B65D 5/46; B65D 5/48

[52] U.S. Cl. ..... 229/117.13; 229/110; 229/120.17

[58] Field of Search ..... 229/109, 110, 117.13, 229/117.14, 117.15, 120.17, 8

[56] References Cited

U.S. PATENT DOCUMENTS

| | | | |
|---|---|---|---|
| 2,718,997 | 9/1955 | Shuxteau | 229/117.14 |
| 2,850,223 | 9/1958 | Strauss | 229/117.14 |
| 2,908,436 | 10/1959 | Miller | 229/120.17 |
| 3,390,810 | 7/1968 | Schneeweiss | 229/120.17 |
| 3,547,339 | 12/1970 | Bruce | 229/117.15 |
| 3,722,782 | 3/1973 | Collie | 229/117.15 |
| 3,967,772 | 7/1976 | Baker | 229/110 |
| 3,977,594 | 8/1976 | Swan | 229/110 |
| 4,250,992 | 2/1981 | Gilbert | 229/117.14 |

*Primary Examiner*—Gary E. Elkins
*Attorney, Agent, or Firm*—Cornelius P. Quinn

[57] ABSTRACT

A hexagonal basket-style carrier formed from a unitary blank. Each side panel is connected to a triangular bottom panel section forming a segment of the bottom panel of the carrier. The bottom panel sections are connected by triangular tuck panels having folds which extend up into the interior of the carrier on opposite sides of the handle to divide the carrier into cells. Tabs on the ends of the handle are connected with slots in the carrier to hold the handle and bottom panel in place.

17 Claims, 3 Drawing Sheets

BASKET-STYLE CARRIER WITH HANDLE AND DIVIDER CELLS

FIELD OF THE INVENTION

This invention relates to an article carrier. More particularly, it relates to a basket-style carrier having divider cells on both sides of a centrally located handle.

BACKGROUND OF THE INVENTION

Basket-style carriers are well known, particularly in connection with the packaging of beverage containers. Typically, a handle extends from one end of a rectangular carrier to the other end, and divider panels connected to a center section or to the side panels divides the space on either side of the handle into article receiving cells. Such a design permits the carrier to be fabricated from a unitary blank. This is a satisfactory arrangement for the purpose, but is inadequate for packaging different types of articles.

For example, the same design features employed in conventional beverage container carriers cannot be used to design a nonrectangular carrier capable of being formed from an economically sized unitary blank, while still providing for a secure handle arrangement and cell dividers. Such a carrier is useful in packaging products whose appeal benefits from being presented in a carrier resembling an actual basket. One such product is a plastic fruit juice container shaped like the fruit from which the juice was obtained.

It is therefore a main object of the invention to provide a nonrectangular basket-style carrier that is structurally sound, pleasing in appearance, easy to fabricate and economical to produce.

BRIEF SUMMARY OF THE INVENTION

The basket-style carrier of the invention comprises an even number of side panels connected to adjacent side panels along fold lines, the side panels being connected along other fold lines to bottom panel sections forming the bottom panel of the carrier. A portion of the bottom edge of a handle section is connected to a bottom panel section along a fold line and means are provided for connecting the end portions of the handle section to the carrier.

The bottom panel sections on each side of the handle section are connected to adjacent bottom panel sections by tuck panels which extend up into the interior of the carrier to divide the carrier on each side of the handle section into cells. In a preferred arrangement one end of the handle section is connected to the carrier by means of a tab extending through a slot in the fold of a tuck panel, while the other end of the handle section is connected to the side of the carrier through a fold connecting adjacent side panels.

The preferred arrangement provides for a hexagonal carrier wherein the bottom panel sections and the tuck panels are triangular. Also, the handle section preferably is formed from two similar handle sections adhered together in face-to-face relationship and foldably connected to opposite ends of the blank from which the carrier is fabricated.

The unitary blank used to form the carrier is simple and economical to produce, and the blank can be readily formed into a carrier. The resulting carrier has considerable strength capable of supporting quite heavy articles and is easy to lift by the handle.

These and other features and aspects of the invention, as well as the benefits thereof, will be clear from the more detailed description of the preferred embodiment which follows.

DETAILED DESCRIPTION OF THE PREFERRED EMBODIMENT

Figure 1:
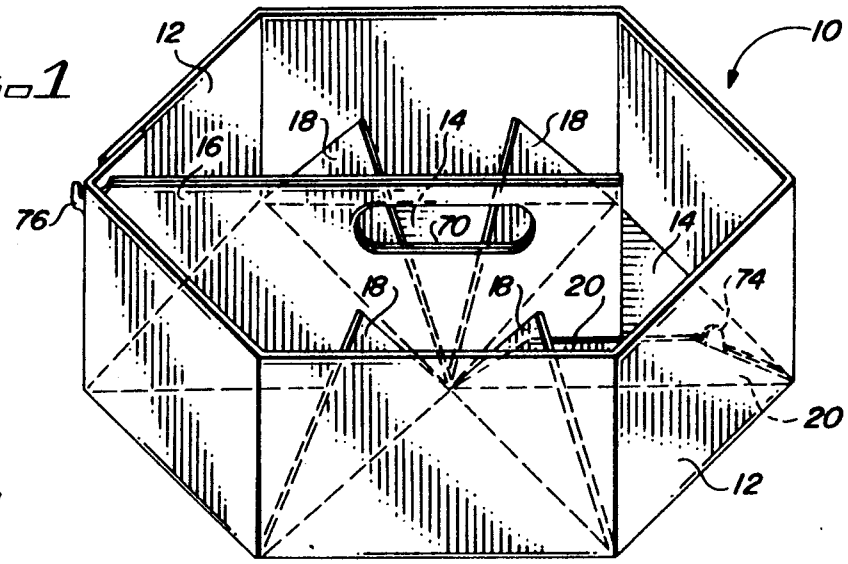
FIG. 1 is a pictorial view of the carrier of the invention.

Referring to FIG. 1, the carrier 10 of the invention is comprised of side panels 12, a bottom panel 14 and a handle section 16. The carrier is in the shape of a regular hexagon, with the side panels corresponding to the sides of the hexagon. Extending up from the bottom panel are dividers 18 and 20, two of the dividers 18 being on either side of the handle section and the divider 20 being aligned with the handle section. Together with the side panels and the handle section, the dividers create six cells for receiving articles to be packaged in the carrier.

Figure 2:
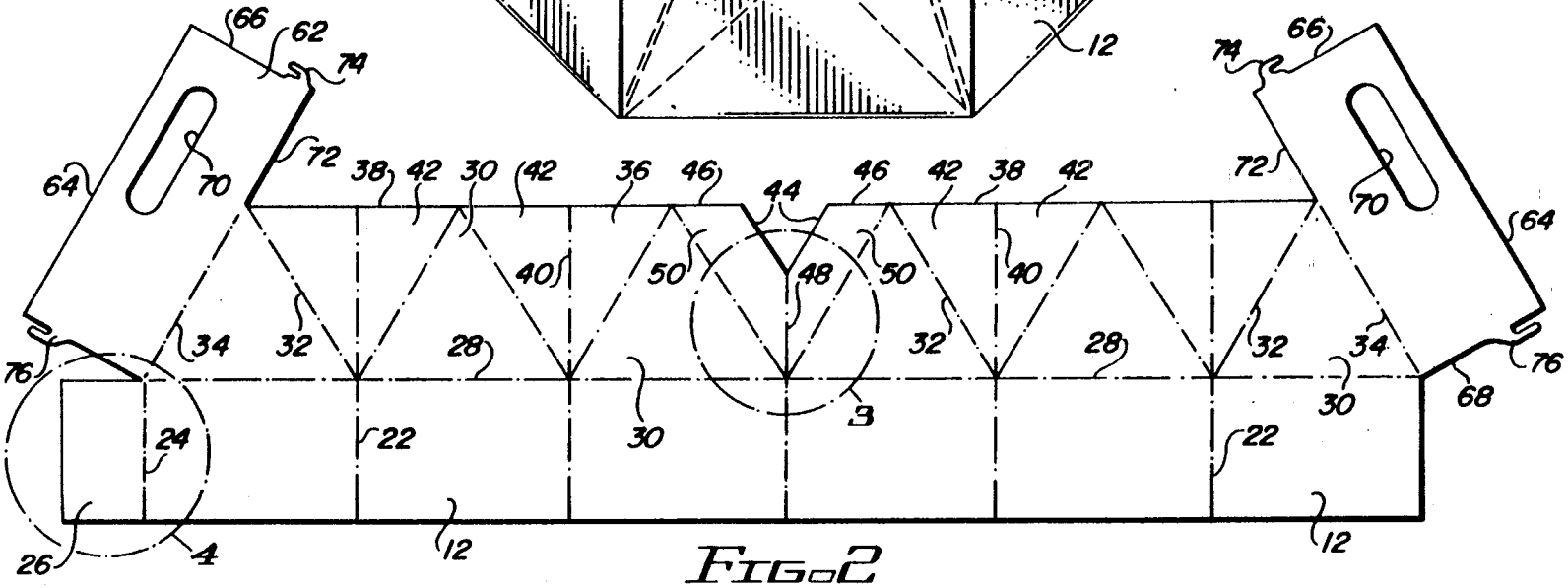
FIG. 2 is a plan view of the blank used to form the carrier of FIG. 1.

The carrier is constructed from the blank shown in FIG. 2, which comprises a row of rectangular side panel sections 12 connected to adjacent panel sections by fold lines 22. The end side panel section 12 at the left side of the drawing is connected by fold line 24 to glue flap 26. Each side panel section 12 is connected by a fold line 28 to a bottom panel section 30 formed in the shape of an equilateral triangle. The fold lines 28 are aligned with each other and are parallel to the opposite edge of the side panels, causing the height of the carrier side panels to be the same. The other two edges of each interior triangular bottom panel section 30 comprise fold lines 32. The inner edge of each end bottom panel section 30 comprises a fold line 32, while the outer edge of each end bottom panel section comprises a fold line 34. Connected to the bottom panel fold lines 32 are tuck panels 36. All the tuck panels 36 except the centrally located one are the same shape as the bottom panel sections to which they are connected, that is, they are in the form of an equilateral triangle. In addition, the unconnected edges 38 of the tuck panels are aligned with each other and connected by fold lines 40 to the interior point of intersection of adjacent fold lines 32. The fold lines 40 are at right angles to the unconnected edges 38 and divide the tuck panels into two similar right triangles 42.

The centrally located tuck panel 36 is similar in size to the other tuck panels except that it is notched, resulting in edges 44 extending from short outer edge segments 46 parallel to the fold lines 32. The point of intersection of the edges 44 is connected to the point of intersection of the associated fold lines 32 by fold line 48, which is parallel to the fold lines 40. The centrally located tuck panel is thus divided by the fold line 48 into two quadrilateral sections 50.

Figure 3:
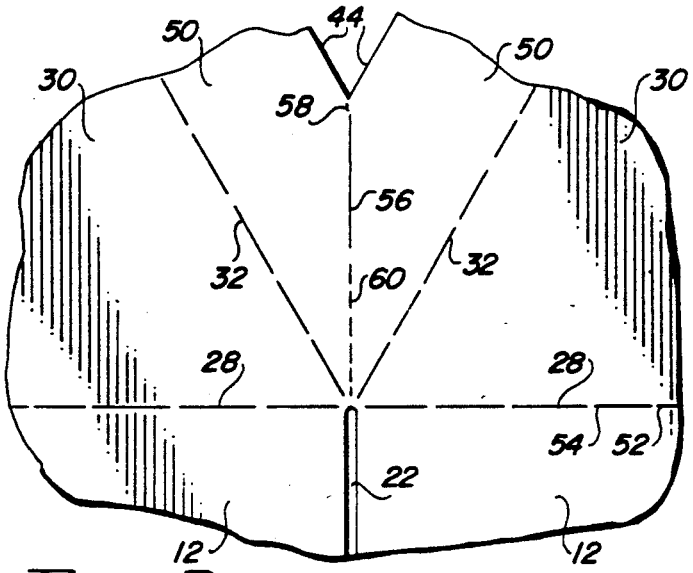
FIG. 3 is an enlarged partial plan view of the portion of the blank of FIG. 2 within the circle 3.

As shown in more detail in FIG. 3, the various fold lines referred to above may take various forms as required. The fold line 22 connecting side panel sections 12 preferably is in the form of a score line, which is stronger than fold lines designed to fold more easily. A score line is well suited for this location since the adjacent panel sections are folded only through an angle of 60°. The fold lines 28 and 32 preferably are of a design that facilitates more severe folding of adjacent sections, and are illustrated as skip-cut lines comprised of relatively long slits 52 separated by sections 54 of intact carrier material, typically paperboard. The fold line 48 which separates tuck panel sections 50 includes a relatively long slit 56 separated from the point of intersection of the edges 44 by a segment 58. The remaining portion of the fold line 48 comprises a skip-cut construction wherein the slits 60 are relatively short. This better suits the short fold line segment between the slit 56 and the point of intersection of the fold lines 32, since long intermittent slits such as the slits 52 would not conveniently fit into the available space and would excessively weaken the fold line.

Referring back to FIG. 2, the outer edge of the end bottom panel sections are connected by the fold lines 34 to identical handle sections 62. Each handle section includes an elongated top edge 64 opposite the fold line 34 and end edges 66 and 68. A handle opening 70 is provided in each handle section near the edges 64 and 66. Each handle section also includes an edge 72 which is aligned with the fold line 34. An upwardly facing tab or hook portion 72 extends from the edge 66 adjacent the edge 72, while an upwardly facing tab or hook portion 76 extends from the edge 68 near the top edge 64.

Figure 4:
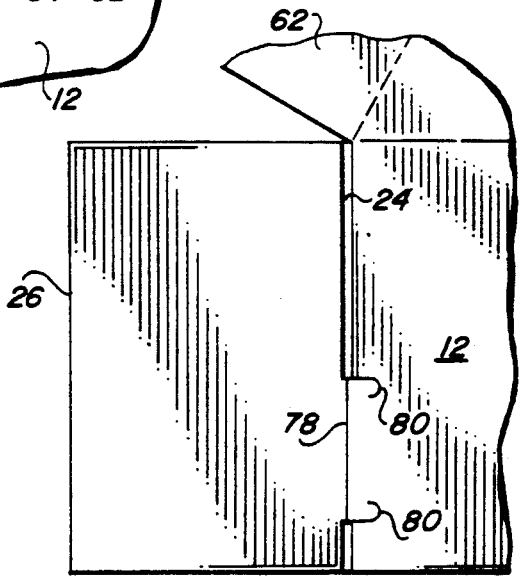
FIG. 4 is an enlarged partial plan view of the portion of the blank of FIG. 2 within the circle 4.

As shown in more detail in FIG. 4, the fold line 24 connecting the glue flap 26 and the adjacent side panel section 12 is preferably a score line similar to the score lines 22. The fold line 24 is interrupted by a single slit 78 which terminates at a point spaced from the bottom edge of the side panel section and glue flap. The ends of the slit 78 may terminate in arcuate slits 80, if desired, in order to prevent tearing at the slit ends in use.

Figure 5:
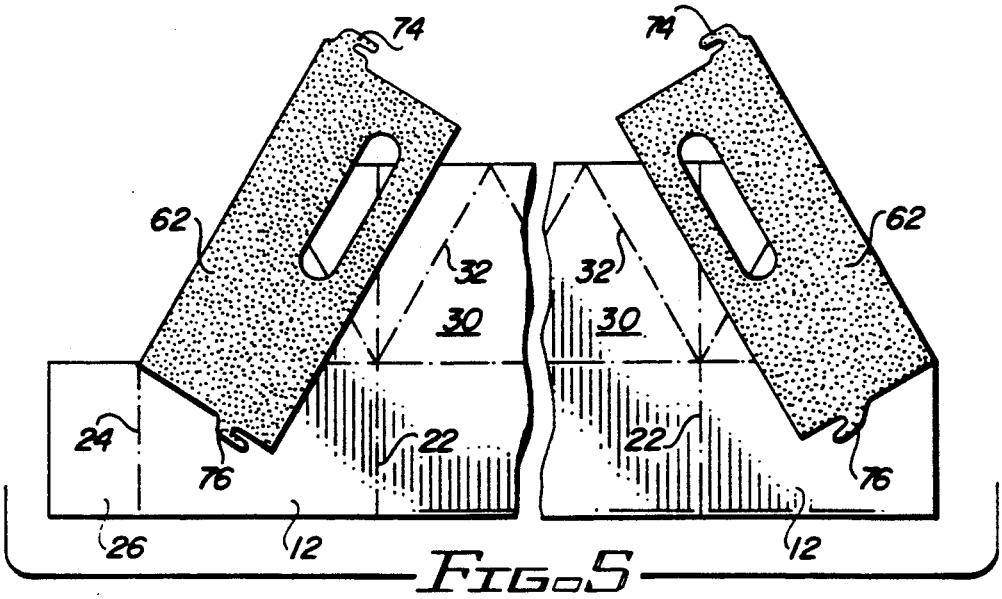
FIG. 5 is a partial plan view of the blank of FIG. 2 in an intermediate stage of carrier formation.

To fabricate the carrier from the blank of FIG. 2, the handle sections 62 are first folded about the fold lines 34 to the positions illustrated in FIG. 5. Then, after applying adhesive to the handle section areas shown in stipple, the blank is folded about the center fold line 22, bringing the handle sections together in face-to-face relationship. The glue flap 26 is folded about its fold line 24 and glued to the opposite end side panel section 12 during the folding operation. The blank at this point appears as shown in FIG. 6, which shows the blank in inverted position.

Figure 6:
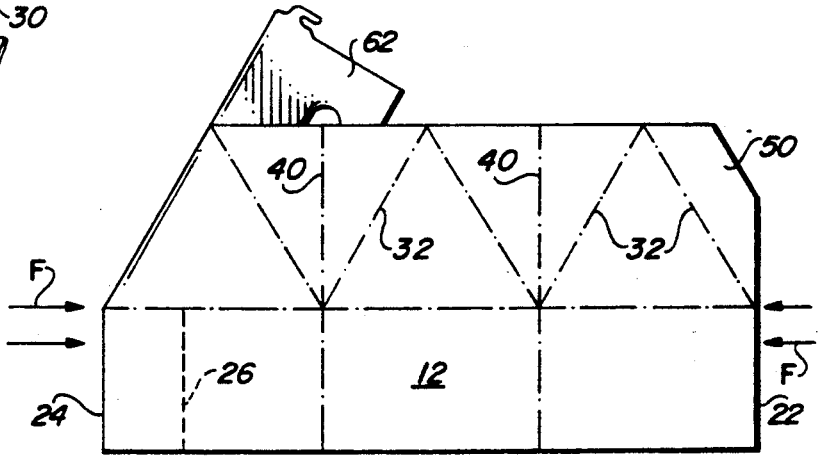
FIG. 6 is a plan view of the blank of FIG. 2 in a further intermediate stage of carrier formation.
Figure 7:
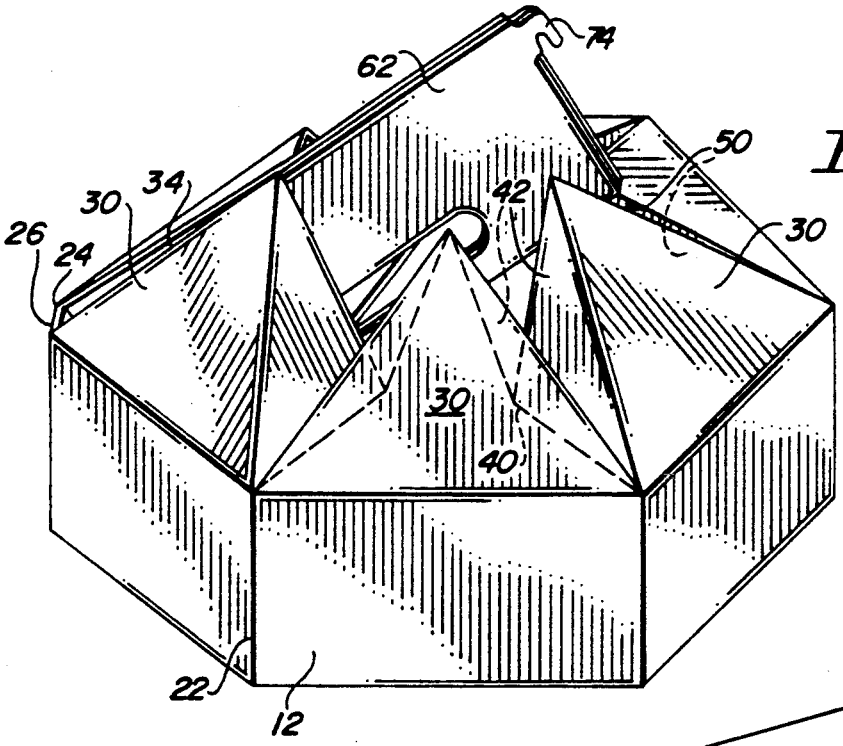
FIG. 7 is a pictorial view illustrating the formation of the bottom panel of the carrier from the blank.

The carrier is set up from the blank of FIG. 6 by applying inwardly directed pressure on the ends of the blank as indicated by the force arrows F. This causes the side panel sections to fold outwardly about the end fold lines 24 and 22 and inwardly about the interior fold lines 22. At the same time the tuck panels 42 and 50 fold in about the fold lines 40 and 48, causing the bottom panel sections 30 to fold down about the fold lines 28 and toward each other about the fold lines 32. It will be understood that the adhered handle sections 62 act as tuck panels in this operation, folding in and down about their fold lines 34. This action is illustrated at an intermediate stage of the folding process by the partially folded blank of FIG. 7, which shows the handle sections 62 pivoting down toward the center of the opposite tuck panel flaps 50.

Figure 8:
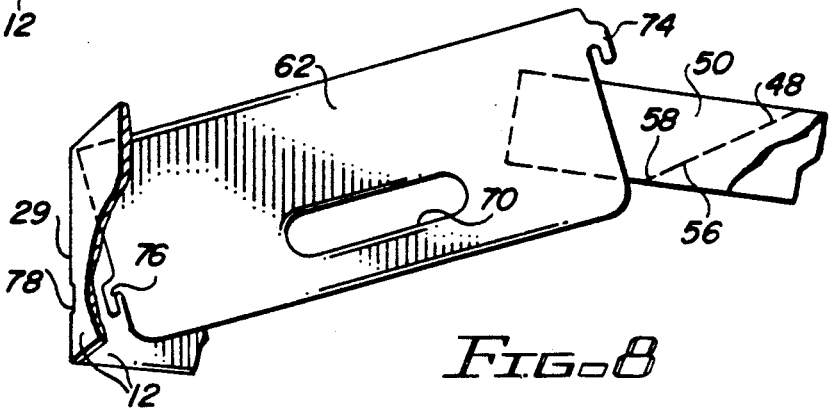
FIG. 8 is a partial pictorial view of the handle section, with some portions of the carrier omitted for purpose of clarity, at a late intermediate stage of carrier formation, illustrating the means for securing the ends of the handle in place.

Continued movement of the tuck panel flaps in toward the center of the carrier brings the handle section to the intermediate position shown in FIG. 8. Downward pivoting movement of the handle, brought about by continued downward movement of the tuck panels and bottom panel sections, has aligned the tab 74 with the slot 56 in the fold line 48 between the tuck flaps 50 and the tab 76 with the slot 78 in the fold line 24 between the glue flap 26 and the adjacent adhered side panel section 12. It can be seen that continued downward pivoting movement of the handle section will result in the open hook of the tab 74 engaging the intact section 58 of the fold line 48 and the tab 74 penetrating the slot 56. The last movement of the handle section that causes the tab 74 to be moved into place also causes the tab 76 at the opposite end of the handle section to move into the slot 78. The engagement of the tabs 74 and 76 with their respective slots mechanically locks the handle section in place, thereby holding the carrier together.

Figure 9:
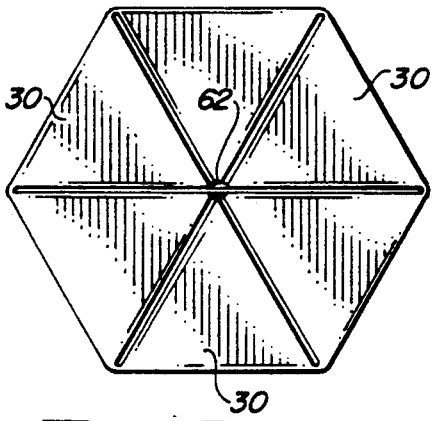
FIG. 9 is a bottom plan view of the assembled carrier.

Referring back to FIG. 1, it will now be appreciated that the dividers 18 are formed from the folded tuck panel faces 42 and the divider 20 from the folded tuck panel faces 50. The handle section terminates short of the opposite corner of the carrier in order for the locking tab 74 to engage the slot in the fold line between the tuck panel faces forming the divider 20. The height of the divider 20 is relatively short to permit locating the tab receiving slot 56 at the correct height to receive the tab 74. As shown in FIG. 9, which is a bottom view of the finished carrier, the carrier is in the shape of a regular hexagon, with each bottom panel section being in the shape of an equilateral triangle and the apex of each such equilateral triangle meeting at the center of the carrier. The bottom panel sections lie in substantially the same plane, creating an essentially continuous bottom panel surface.

The carrier is designed to be conveniently lifted by the handle opening 70, with articles of any desired shape being retained in position by the cell dividers. The carrier is not only sturdy, but is designed so that the heavier the load the tighter the bottom panel sections are held in place. This is due to the fact that downward pressure on the bottom panel sections while the user holds the handle tends to force the tabs 74 and 76 into tighter engagement with their associated slots.

Although the invention has been described in connection with a carrier in the shape of a regular hexagon, it will be appreciated that it can be employed in carriers of different shape having an even number of sides.

The invention is not limited to all the specific details described in connection with the preferred embodiment, but may incorporate changes in details which do not affect the overall basic function and concept of the invention and do not depart from the spirit and scope of the invention, as defined in the appended claims.

What is claimed is:

1. A nonrectangular basket-style article carrier, comprising:

a plurality of side panels connected to adjacent side panels along first fold lines, the total number of side panels being an even number;

each side panel being connected along a second fold line to a bottom panel section;

each bottom panel section being situated between adjacent bottom panel sections, the bottom panel sections forming the bottom panel of the carrier;

a handle section having opposite end portions and a bottom edge, a portion of the bottom edge being connected to a bottom panel section along a third fold line; and means for connecting the end portions of the handle section to the carrier.

2. The article carrier of claim 1, wherein the handle section lies in a plane which extends substantially at right angles to the bottom panel and substantially bisects the carrier.

3. The article carrier of claim 2, wherein the bottom panel sections on each side of the handle section are connected to adjacent bottom panel sections by tuck panels, the tuck panels extending up into the interior of the carrier to divide the carrier on each side of the handle section into cells.

4. The article carrier of claim 3, wherein one end portion of the handle section terminates at a point between two adjacent bottom panel sections between adjacent faces of the associated tuck panel.

5. The article carrier of claim 4, wherein the one end portion of the handle section terminates short of the nearest side panel.

6. The article carrier of claim 4, wherein the means for connecting said one end portion of the handle section to the carrier comprises a tab on the handle section extending through a slot in the tuck panel.

7. The article carrier of claim 6, wherein the slot in the tuck panel coincides with a portion of a fold line connecting opposite faces of the tuck panel.

8. The article carrier of claim 6, wherein the means for connecting the other end of the handle section to the carrier comprises a tab on the handle section extending through a slot in one of the first fold lines connecting adjacent side panels.

9. The article carrier of claim 1, wherein the handle section comprises two adhered layers, each layer being connected by a third fold line to the adjacent edge of adjacent bottom panel sections.

10. The article carrier of claim 3, wherein the carrier is hexagonal in shape, each bottom panel section forming a substantially equilateral triangle and each side panel being rectangular in shape.

11. The article carrier of claim 10, wherein the tuck panels are substantially in the shape of equilateral triangles, each such equilateral triangle being divided into halves by a fold line to form opposite faces of the associated tuck panel.

12. A blank for forming a nonrectangular basket-style article carrier, comprising:

a plurality of rectangular side panel sections arranged in a row, interior side panel sections in the row being connected to adjacent side panel sections along first fold lines;

each side panel section being connected along a second fold line to a bottom panel section;

a handle section having two end portions and a bottom edge, a portion of the bottom edge being connected to an end bottom panel section along a third fold line; and means for connecting the end portions of the handle section to the blank to hold the handle section in place in a carrier formed from the blank, the bottom panel sections together forming the bottom panel of such a carrier.

13. The article carrier blank of claim 12, wherein the bottom panel sections situated between adjacent bottom panel sections are connected to the adjacent bottom panel sections by tuck panels, the tuck panels being dimensioned to extend up into the interior of a carrier formed from the blank to divide the carrier on each side of the handle section into cells.

14. The article carrier blank of claim 13, wherein the means for connecting one end portion of the handle section to a carrier formed from the blank comprises a tab on the handle section and a slot in a fold line connecting opposite faces of a tuck panel centrally located in the blank.

15. The article carrier blank of claim 14, wherein an end side panel section is connected to a glue flap along a fold line, and wherein the means for connecting the other end portion of the handle section to a carrier formed from the blank comprises a tab on said other end portion of the handle section and a slot in the fold line connecting the glue flap to the adjacent side panel.

16. The article carrier blank of claim 12, including a second handle section having two end portions and a bottom edge, a portion of the bottom edge being connected to the other end bottom panel section along another third fold line, the handle sections being adapted to be adhered together in face-to-face relationship in a carrier formed from the blank.

17. The article carrier blank of claim 13, wherein each bottom panel section and each tuck panel is in the shape of a substantially equilateral triangle, each tuck panel equilateral triangle being divided into halves by a fold line aligned with the first fold lines connecting the side panel sections to form opposite faces of the associated tuck panel, whereby the carrier formed from the blank is hexagonal in shape.

* * * * *